United States Patent [19]

Hoyrup et al.

[11] 4,420,924

[45] Dec. 20, 1983

[54] APPARATUS AND METHOD FOR INVERTING AND APPLYING FLANGED LIDS TO ERECTED CARTONS

[75] Inventors: S. Johannes Hoyrup, Monta Vista; Karl A. Krause, Mokelume Hill, both of Calif.

[73] Assignee: Kliklok Corporation, Greenwich, Conn.

[21] Appl. No.: 298,607

[22] Filed: Sep. 1, 1981

[51] Int. Cl.[3] ..... B65B 7/28

[52] U.S. Cl. ..... 53/307; 53/314

[58] Field of Search ..... 53/307, 309, 314, 282, 53/315, 313, 316, 485

[56] References Cited

U.S. PATENT DOCUMENTS

| | | | |
|---|---|---|---|
| 1,705,082 | 3/1929 | Brigham | 53/314 X |
| 2,522,437 | 9/1950 | Enkur | 53/314 X |
| 2,750,722 | 6/1956 | Ferguson et al. | 53/315 X |
| 3,282,025 | 11/1966 | Amberg et al. | 53/282 X |
| 3,383,834 | 5/1968 | Switliski et al. | 53/315 |
| 3,533,216 | 10/1970 | Lange | 53/314 |
| 3,626,659 | 6/1970 | Breitbach . | |
| 3,694,999 | 10/1972 | Switliski et al. | 53/313 |
| 4,077,188 | 3/1978 | Strombeck et al. | 53/314 X |
| 4,122,649 | 10/1978 | Sawvel | 53/314 X |
| 4,139,979 | 2/1979 | Nakazato et al. | 53/307 X |

FOREIGN PATENT DOCUMENTS

| | | | |
|---|---|---|---|
| 1291310 | 10/1972 | United Kingdom | 53/314 |

*Primary Examiner*—Horace M. Culver

*Attorney, Agent, or Firm*—King and Liles

[57] ABSTRACT

A method and apparatus for handling and applying formed flanged lids to a carton is disclosed. Inverted lids drop on an upper conveyor belt directly from a forming machine for travel in a first direction. The lids subsequently drop and flip to the desired upright position on a lower conveyor belt for movement toward a lidding station. To prevent over-flipping, the trailing edge is guided by a vertical guide plate. An idler belt is positioned downstream of the second conveyor belt and above the feed path. A lug on the idler belt engages the leading edge of the lid being transferred from the second conveyor belt. The lug holds the lid in proper alignment for driving forwardly by abutting engagement of the carton intersecting with the leading edge of the lid. The idler belt is carried by a pair of idler rollers. An adjustable brake on one of the rollers controls the drag on the belt to restrain the lid and assure positive lidding action on the carton. As the carton moves beneath the idler belt, the lid is progressively seated onto the carton. A second or trailing lug on the idler belt serves to press down the trailing edge. The next in-line lug is timed to be positioned at the lidding station to intercept the next lid for application to the next in-line carton.

4 Claims, 4 Drawing Figures

APPARATUS AND METHOD FOR INVERTING AND APPLYING FLANGED LIDS TO ERECTED CARTONS

TECHNICAL FIELD

This invention generally relates to handling and applying formed lids with flanges to cartons, and more particularly, to a method and apparatus effective for inverting flanged lids dropping from a lid forming machine, and applying the lids into full seating engagement on the cartons.

BACKGROUND ART

Commercially available frozen foods, such as ice cream, are packaged in cartons impervious to water vapor and odors. The cartons are usually fabricated of plastic coated paperboard erected to include four sides, a bottom panel and a hinged top cover having depending flanges overlying the upper edges of the sides.

A new form of carton for ice cream or the like has a removable paperboard flanged lid. The carton has short vertical flanges provided along the upper edges of the sides. When folded downwardly and inwardly along the margins of the carton mouth, a peripheral sealing area is defined. The separate lid covering the mouth engages the flanges and the upper edges of the sides to seal the contents.

The process of automatically filling and closing this new form of carton presents a unique lid seating problem to be solved. Specifically, after the erected cartons are filled with food product, the separately formed lids must be positively seated on the carton. Full sealing engagement with the carton flanges folded along the margins of the carton mouth must be attained.

The preferred apparatus and method for folding the flanges is disclosed in copending U.S. patent application Hoyrup, Ser. No. 283,553 filed July 15,1981, and assigned to the same asignee.

Especially where the cartons are filled with a liquid product, it is highly desirable to seat the flanged lids on the cartons during the lidding operation as gently as possible to avoid potential spillage of the product. This capability is lacking in the prior art.

The lids applied to seal the contents within the cartons are erected or formed in a lid forming machine. The lids are released from the forming machine upside-down and thus must be inverted before being applied to the cartons. It has proved difficult in the past to invert the lids while maintaining the high speed operation essential to efficient production. Utilizing prior inverting techniques, jamming can occur requiring manual repositioning and loss of valuable production time.

In many prior art machines, the lidding sequence is dependent upon precise timing and arrival of the lids and cartons to effect full seating engagement. Should improper timing occur, possible jamming of lids at the lidding station can result. A similar jamming problem can also result in the event of an empty flight (missing carton) on the carton conveyor. Thus, the requirement for precise, timed movement between the lids and cartons is a shortcoming of many prior art lidding machines and should be corrected.

Another difficulty encountered with prior art machines is that during the lidding sequence, the carton sides often tend to bow outwardly so as to preclude ready application of the lid to the carton. Correction of this problem has previously been attempted, but without success.

DISCLOSURE OF THE INVENTION

It is accordingly an object of the present invention to provide a method and apparatus for handling and applying lids to cartons to assure positive, gentle seating engagement.

Another object of the invention is to provide an inverting method and apparatus for carton lids for positive upright positioning and delivery to the lidding station and avoiding jamming problems of the past.

Another object of the invention is to provide an apparatus and method for inverting lids by controlled movement during transition between two conveyors.

It is another object of the present invention to provide effective delivery and engagement of lids with cartons without requiring precise, timed arrival between each carton and lid.

Still a further object is to provide a lidding apparatus allowing full seating engagement while controlling outward bowing of the carton sides.

Still a further object is to provide a compact apparatus capable of efficient and rapid operation for use in applying flanged lids to cartons.

A further object is to provide combined apparatus and method for inverting lids and applying the lids to cartons in sequence utilizing controlled and positive handling and lidding techniques.

Still another object is to provide a lid inverting and applying system, simple in design, and economical to manufacture and maintain.

Additional objects, advantages and novel features of the invention will be set forth in detail in part in the description which follows and in part will become apparent to those skilled in the art upon examination of the drawing, or may be learned by practice of the invention. The objects and advantages of the invention may be realized and attained by means of the instrumentalities and combinations particularly pointed out in the appended claims.

The handling and lidding apparatus of the present invention is capable of inverting formed, flanged lids into upright position to effect full seating engagement with erected cartons. The apparatus includes an upper belt conveyor system receiving the inverted lids directly from a lid forming machine for travel in a first direction. A lower conveying belt positioned beneath the upper conveyor has a receiving section positioned below the discharge end of the upper conveyor. The lower receiving belt moves in the opposite direction from the upper belt and receives the lids dropping in free fall or cascading movement from the upper belt, thus forming the inverting station.

The upper and lower feed paths defined by the respective belts are spaced from each other to allow flipping of the flanged lids to the upright position on the lower belt. The lid flipping action occurs when the leading edge of the lid falls onto the lower belt and the reverse movement of the lower belt causes the trailing edge to continue forwardly, and thus flip over. The lid lands on the lower belt in the upright position in readiness for applying to the cartons.

A vertical guide plate is positioned adjacent the upstream end of the receiving section of the lower conveying belt and is operative to deflect the trailing lid edge to prevent overflipping and to thus guide the lid into the desired upright position. The upright lids are conveyed along the lower feed path for discharge onto a transfer plate extending downwardly from the discharge end of the lower conveyor belt to the lidding station. The downward inclination of the lower belt and transfer plate is in the direction of lid travel, allowing the lid to slide into the operative position for engagement with the carton arriving at the lidding station on a carton conveyor.

The leading edge of the lid positioned at the lidding station abuts one of a plurality of lugs attached to an endless idler belt. The lug holds the lid stationary and in alignment with an advancing carton on the carton conveyor intersecting the lower feed path adjacent the transfer plate. Contact between the leading lid edge and moving carton drives the lug forward while pulling the idler belt around supporting idler rollers. One of the idler rollers may be braked by adjustable brake means to provide the desired accurate positioning of the lugs and firm engagement for improved control of the lidding operation.

Thus, the carton moves beneath the idler belt, the belt is pushed forward and the lid is restrained and progressively seated on the carton. The progressive engagement of the lid in conjunction with the control provided by the seating lugs and the side guide rails results in a gentle and smooth lidding operation. This action effectively prevents outward bowing of the carton walls. A second or trailing lug on the idler belt progressively presses down adjacent to the trailing edge for full lid seating engagement. The trailing lug is then positioned at the lidding station to intercept the next lid as the previous lug disengages from the carton, and the belt stops. A pair of seating rollers coaxially mounted on opposite ends of the downstream idler roller is dimensioned to contact the lateral edges of the lid on the carton to assure full seating engagement.

BEST MODE FOR CARRYING OUT THE INVENTION

Figure 1:
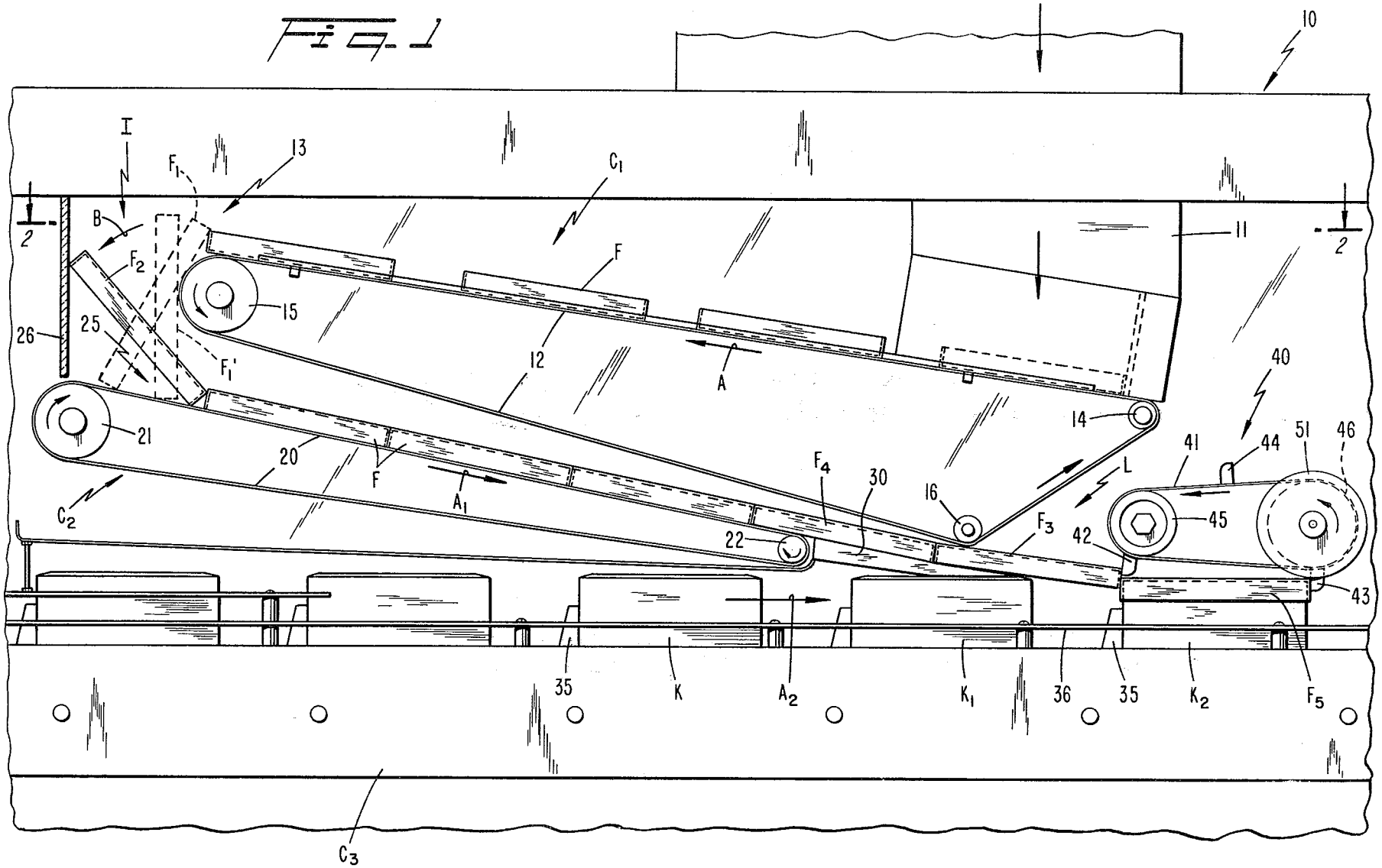
FIG. 1 is a side view of the inverting and lidding apparatus according to the present invention, illustrating the positioning of conveyor belts and vertical guide plate for flipping lids into the upright position, and conveying and applying lids into full seating engagement with the erected cartons.

With reference now to FIG. 1 of the drawings, a lid handling apparatus 10 constructed in accordance with the present invention to invert and apply flanged lids F to cartons K is illustrated. The lids F are initially received from a lid forming machine (not shown) through an enclosed guide 11. The lids F drop in an upside down position onto an upper conveyor, generally designated by the reference indicia $C_1$.

Figure 2:
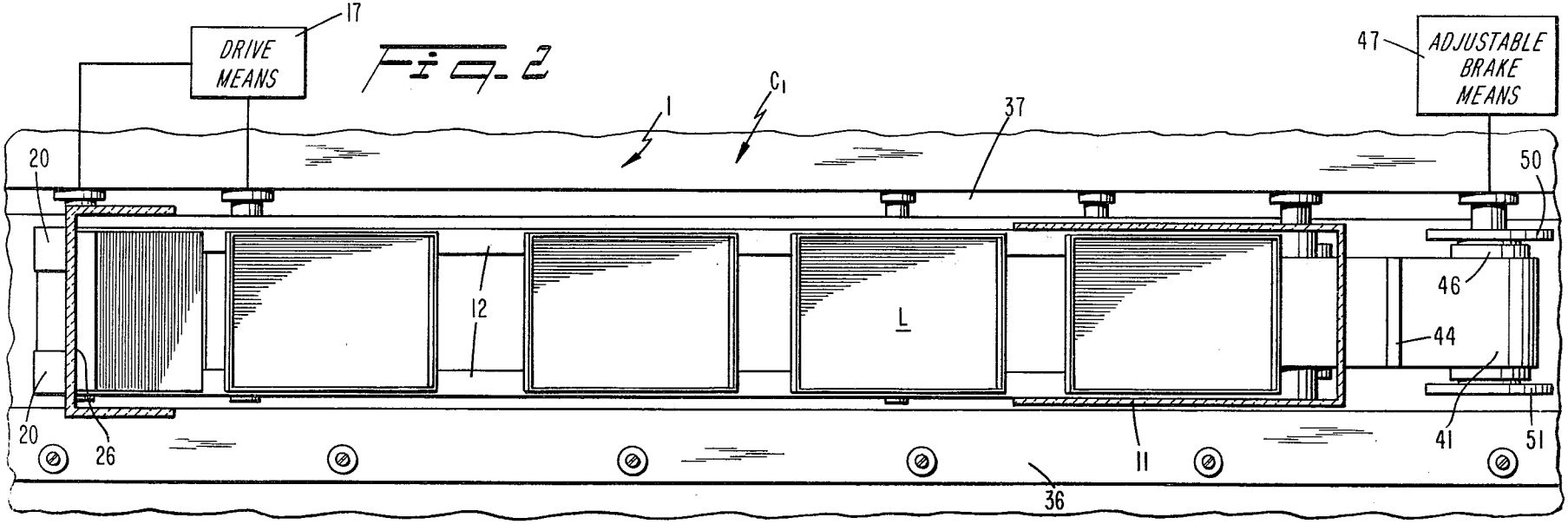
FIG. 2 is a top plan view of the apparatus shown in FIG. 1 illustrating lid travel along the upper conveyor belt and placement of the idler belt and lug arrangement at the lidding station.

The upper conveyor $C_1$ comprises belt means defined in the preferred embodiment by spaced endless belts 12 (see FIG. 2). The conveyor $C_1$ is inclined upwardly from the guide 11 to a discharge end 13. The belts 12 are supportedby an idler roller 14 adjacent the guide 11 and a drive roller 15 at the discharge end.

An intermediate guide roller 16 is positioned along the lower run of the belts 12. The roller 15 is driven by suitable drive means 17 in the direction of the feed arrow A shown in FIG. 1. The flanged lids F moving along the upper run of the conveyor $C_1$ define the upper feed path of the handling apparatus 10 of the present invention.

Positioned below the upper conveyor $C_1$ is a lower conveyor $C_2$ having belts 20 driven by drive roller 21, receiving input driving force from drive means 17, and idler roller 22. The conveyor $C_2$ is inclined downwardly so that the flanged lids F are abutting and slanted downwardly toward a lidding station L.

The belts 20 are of an over-running type providing constant forward feeding force to the abutting lids F (see feed arrow $A_1$). When the motion of the lids F is temporarily stopped between the lidding operations at the lidding station L, the belts 20 continue to be driven and simply slide beneath the lids. The lower feed path is of course defined as the path of movement of the lids F, along the lower conveyor, as shown in FIG. 1.

In accordance with the present invention, an improved method and apparatus for inverting the lids is provided. The inverting station of the handling apparatus 10 is designated by the reference indicia I. As best shown in FIG. 1, the inverting station I is adjacent the discharge end 13 of the upper conveyor $C_1$. The bottom of the inverting station I is formed by a receiving section 25 of the lower conveyor $C_2$.

In the feeding operation, the flanged lids F free-fall or drop in a cascading manner over the end of the conveyor $C_1$. The leading edge of the lid being inverted assumes the dotted line position, as shown by the lid $F_1$. As the lower belts 20 move in the direction opposite to the original direction of movement of the lids, the leading edge of the lid $F_1$ is directed in a downward direction and assumes a new position as lid $F_1'$ (also shown in dotted line outline in FIG. 1).

As the conveyor $C_2$ continues to move, the lid $F_2$ flips over, with the trailing edge moving as shown by the arrow B. This movement is in the same direction as the feed path movement in accordance with the arrow A along the upper conveyor $C_1$. The trailing edge of the lid $F_2$ engages a vertical guide plate 26 with the leading edge continuing along with the lower conveyor $C_2$ into abutting relationship with the next in-line lid F. The guide plate 26 controls the flipping action of the lid $F_2$ and prevents over flipping that could provide jamming. The spacing between the discharge end 13 and the guide plate 26 is less than the length of the lids F to assure this action.

At the inverting station I, it can be seen that the lids are handled in a controlled manner during the transition. The flipping action is rapid to maintain the high speed operation. The reverse movement of the conveyor $C_2$ also assures proper inversion of each lid F to the desired right-side-up position.

All of the lids F along the lower conveyor $C_2$ are in abutting relationship so that the lids are maintained in readiness along the feed path. Adjacent the discharge end of lower conveyor $C_2$ is a transfer plate 30 supporting the flanged lid $F_3$ at the lidding station, as well as the next in-line lid $F_4$. The top of the lid $F_3$ is engaged from above by the lower run of the belts 12 at the turning point of the intermediate guide roller 16.

The lower portion of the handling apparatus 10 of the present invention includes a feed conveyor $C_3$ for the cartons K moving along the feed path $A_2$. The feed path $A_2$ intersects the feed path $A_1$ of the flanged lids at the lidding station L (note flanged lid $F_3$ positioned in readiness for seating on carton $K_1$). The cartons K are driven serially by suitable chain conveyor means having driving lugs 35. Guide rails 36, 37 (see FIGS. 1 and 2) engage the sides of the cartons, and in addition to guiding the cartons along the feed path $A_2$, help prevent outward bowing of the sides during the lidding operation.

Figure 4:
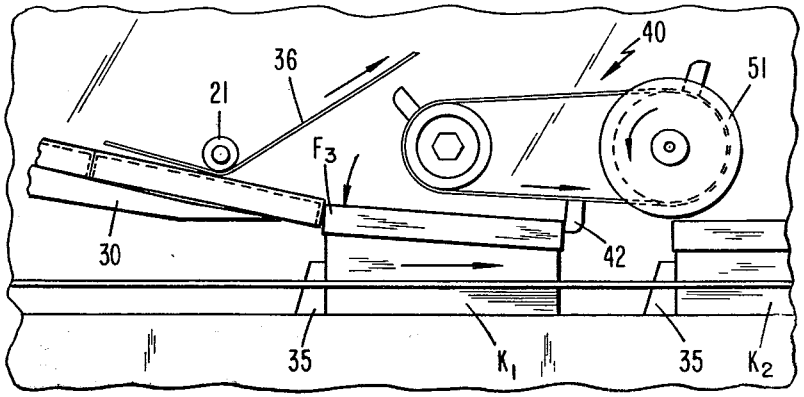
FIG. 4 is a side view similar to FIG. 3 illustrating progressive seating engagement of the lid on the carton by the idler belt.
Figure 3:
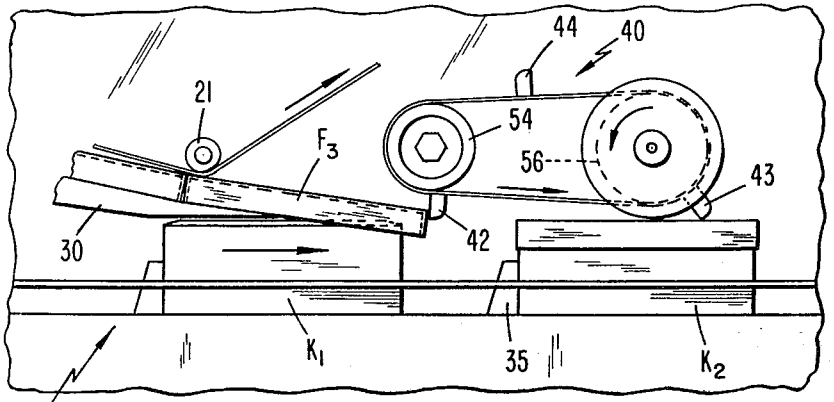
FIG. 3 is a partial side view of the lidding station illustrating lid positioning and retention for seating engagement with an advancing carton.

In order to more fully describe the lidding operation, reference is made to FIGS. 1, 3 and 4. The lid $F_3$ in FIG. 1 is being driven forwardly by the lower run of the upper belts 12 around guide roller 16, and by the pushing action of the next in-line lid $F_4$. The carton $K_1$ being fed by the carton conveyor $C_3$ moves under the lid $F_3$ and between the depending flanges. The lid applying apparatus, generally designated by the reference 40, includes an idler belt 41 having a plurality of lugs 42, 43, 44. The belt 41 is mounted for idler movement by rollers 45, 46. Attached to the support shaft for the roller 46 is an adjustable brake means 47 (see FIG. 2). Positioned at the sides of the belt 41 are two seating rollers 50, 51. The rollers 50, 51 are larger in diameter than the roller 46 supporting the belt 41, and accordingly are operative to engage the lateral edges of the flanged lid to assure final seating action.

Following the sequence of operation of the lid applying apparatus 40, as shown in FIG. 1, the cartons K are being transported along the conveyor $C_3$ and the lid $F_3$ is stopped in engagement with the seating lug 42 positioned at the lidding station L. In addition, the lug 42 is pressed against the rear edge of lid $F_5$ of carton $K_2$ to firmly seat the rear of the lid.

As the lugs 35 continue to feed the cartons along the conveyor $C_3$, the approaching carton $K_1$ moves into partial engagement with the lid $F_3$ (FIG. 3). The lead carton $K_2$ continues to move forward and pushes the leading lug 43 out of the way, thus stopping lug 42 at the final lid aligning position (see FIG. 3). Finally in FIG. 4, the lead carton $K_2$ has cleared the seating rollers 50, 51, the lid $F_3$ drops off the end of the transfer plate 30 and is preliminarily seated on the corresponding carton $K_1$. The seating lug 42 during this time restrains the lid and keeps the leading edge of the lid $F_3$ firmly seated against the leading edge of the carton $K_1$.

As shown in FIG. 2, the seating lug 44 is relatively wide providing a firm abutment for the leading edge of the lid to engage. In the position shown in FIG. 1, the seating lug, the seating rollers 50, 51 and the trailing lug 42 all firmly engage the lid $F_5$ on carton $K_2$ to provide the seating function. As the carton $K_2$ continues to move under the rollers 50, 51, the lateral edges of the lid are firmly pressed down providing the final seating function.

In conclusion, it can be seen that a highly efficient, combined handling and lidding operation is provided. The lids F are fed along an upper feed path and to an inverting station I. At the inverting station, the lids cascade down to a receiving section 25 of the lower conveyor $C_2$ and defining the lower feed path. The lower conveyor $C_2$ is moving in the opposite direction, and thus moves the leading edge of the lid F causing the lid to flip and assume the desired upright position. A vertical plate 26 confines the lids and assures the proper flipping action. The lids are then fed to the lidding station L for interception by the cartons K. The lid applying apparatus 40 gently applies the lids while maintaining control of the lids along the feed path.

The foregoing description of the preferred embodiment of the invention has been presented for purposes of illustration and description. It is not intended to be exhaustive or to limit the invention to the precise form disclosed, and obviously many modifications and variations are possible in light of the above teaching. The embodiment as chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

We claim:

1. Apparatus for inverting and applying flanged lids to cartons, comprising:

(a) upper conveying means defining an upper feed path extending in a first direction for receiving and conveying inverted lids;

(b) lower conveying means defining a lower feed path moving in a second direction, said lower conveying means positioned beneath the upper conveying means for receiving the lids from said upper conveying means, said upper and lower feed path being spaced apart from each other;

(c) inverting means for said flange lids to provide upright lid position during the transition from the upper to the lower feed path;

(d) transfer means receiving and supporting the lids being discharged from the lower conveying means and presenting the lids to a lidding station;

(e) carton conveyor means intersecting said lower feed path adjacent said transfer means at said lidding station;

(f) means positioned downstream of the lid transfer means for applying the lid to the carton;

(g) an endless member having a plurality of lugs, a first lug being positioned at said lidding station to initially align and engage the leading edge of the lids with the corresponding moving cartons, said endlesss member and said lugs having idler movement in the direction of carton travel to said lids;

(h) means for braking said idler movement for engaging said lids to firmly engage said lug and allow the lids to be securely applied;

(i) a second in-line lug contacting the lids adjacent the trailing edge for seating engagement on the cartons.

2. The apparatus of claim 1 wherein said applying means includes roller means for engaging the lateral edges of the lids on the cartons for further seating action.

3. Apparatus for inverting and applying flange lids to cartons, comprising:

(a) upper conveying means defining an upper feed path extending in a first direction for receiving and conveying inverted lids including endless belt means having receiving and discharge ends, said receiving end positioned below a discharge guide dropping inverted lids onto the conveyor;

(b) lower conveying means defining a lower feed path moving in a second direction including endless belt means positioned in substantially vertical alignment with the upper conveying means, said lower conveying means positioned beneath the upper conveying means for receiving the lids from said upper conveying means, said upper and lower feed paths being spaced apart from each other;

(c) inverting means for said flanged lids to provide upright lid position during the transition from the upper to the lower feed path including the receiving section of the lower conveying means spaced in relation to the discharge end of the upper conveying means and receiving inverted lids dropping from the upper conveying means onto the lower conveying means, said receiving section being less than the length of the lid, thereby controlling and supporting the lid on the upper and lower conveying means during flipping movement, said inverting means further comprising a substantially vertical guide plate positioned in alignment with receiving section of the lower conveying means, said vertical guide plate deflecting the trailing edge of the lid during flipping movement to allow controlled upright positioning of the lid on the lower conveying means;

(d) transfer means receiving and supporting the lids being discharged from the lower conveying means and presenting the lids to a lidding station;

(e) carton conveyor means intersecting said lower feed path adjacent said transfer means at said lidding station;

(f) means positioned downstream of the lid transfer means for applying the lids to the cartons.

4. Apparatus for inverting and applying flanged lids to cartons, comprising:

(a) upper conveying means defining an upper feed path extending in a first direction for receiving and conveying inverted lids;

(b) lower conveying means defining a lower feed path moving in a second direction, said lower conveying means positioned beneath the upper conveying means for receiving the lids from said upper conveying means, said upper and lower feed paths being spaced apart from each other;

(c) inverting means for said flange lids to provide upright lid position during the transition from the upper to the lower feed path;

(d) transfer means receiving and supporting the lids being discharged from the lower conveying means and presenting the lids to a lidding station;

(e) carton conveyor means intersecting said lower feed path adjacent said transfer means at said lidding station;

(f) means positioned downstream of the lid transfer means for applying the lids to the carton;

(g) an idler belt carried in longitudinal alignment with the lower feed path, and lugs on said idler belt to engage the leading edge of the lid, said lugs being spaced apart from each other a distance less than the length of the lid, enabling a second in-line lug to contact the trailing lid edge as a moving carton advances beneath the idler belt.

* * * * *